US007731199B2

(12) United States Patent
Fukazawa et al.

(10) Patent No.: US 7,731,199 B2
(45) Date of Patent: Jun. 8, 2010

(54) PRIZE ACQUISITION GAME APPARATUS

(75) Inventors: Mitsuharu Fukazawa, Ohta-Ku (JP); Takashi Yamamoto, Ohta-Ku (JP); Kouki Takasugi, Ohta-Ku (JP)

(73) Assignee: Kabushiki Kaisha Sega, Tokyo (JP)

( * ) Notice: Subject to any disclaimer, the term of this patent is extended or adjusted under 35 U.S.C. 154(b) by 662 days.

(21) Appl. No.: 11/666,642

(22) PCT Filed: Jun. 9, 2005

(86) PCT No.: PCT/JP2005/011002

§ 371 (c)(1),
(2), (4) Date: Apr. 30, 2007

(87) PCT Pub. No.: WO2006/046328

PCT Pub. Date: May 4, 2006

(65) Prior Publication Data

US 2008/0001360 A1 Jan. 3, 2008

(30) Foreign Application Priority Data

Oct. 29, 2004 (JP) ..... 2004-317113

(51) Int. Cl.
*A63B 67/00* (2006.01)

(52) U.S. Cl. ..... 273/447; 273/440

(58) Field of Classification Search ..... 273/447, 273/448, 440; 463/7
See application file for complete search history.

(56) References Cited

U.S. PATENT DOCUMENTS 5,711,530 A 1/1998 Lewis
6,283,475 B1 * 9/2001 Stubben ..... 273/448

(Continued)

FOREIGN PATENT DOCUMENTS

JP 2-68083 A 5/1990

(Continued)

OTHER PUBLICATIONS

Clena-Flex, Namco Ltd., National Center for Industrial Property Information, Ukeire, Sep. 2, 2004.

(Continued)

*Primary Examiner*—Peter DungBa Vo
*Assistant Examiner*—Alex F. R. P. Rada, II
(74) *Attorney, Agent, or Firm*—Wenderoth, Lind & Ponack, L.L.P.

(57) ABSTRACT

A prize acquisition game apparatus is provided which does not require the effort of replacing an interchangeable discharging port structure unit but rather has a discharging port the size of which can be easily changed.

The prize acquisition game apparatus comprises: operation means which is operated by a player; a prize housing section for housing a plurality of prizes; prize acquiring means for acquiring a said prize; a discharging port which is formed in the prize housing section for discharging the prize from the prize housing section; control means for controlling the prize acquiring means to operate in response to an operation signal from the operation means; a discharged prize receiving section for receiving the prize discharged through the discharging port by the prize acquiring means which operates under the control of the control means; and sliding means for sliding a frame which is provided on the discharging port to change the size of the discharging port according to a distance the frame is slid.

3 Claims, 8 Drawing Sheets

U.S. PATENT DOCUMENTS

| | | | | |
|---|---|---|---|---|
| 6,770,001 | B1 | 8/2004 | Shoemaker, Jr. | |
| 7,334,798 | B2 * | 2/2008 | Halliburton | 273/447 |
| 7,594,662 | B2 * | 9/2009 | Fukazawa et al. | 273/447 |
| 2002/0067002 | A1 | 6/2002 | Yoshida et al. | |
| 2003/0090065 | A1 * | 5/2003 | Carter et al. | 273/447 |
| 2003/0151202 | A1 * | 8/2003 | Fisher et al. | 273/447 |

FOREIGN PATENT DOCUMENTS

| | | | |
|---|---|---|---|
| JP | 7-13756 | | 4/1995 |
| JP | 08-212438 | A | 8/1996 |
| JP | 2004-105752 | A | 4/2004 |
| JP | 2005-080941 | A | 3/2005 |
| JP | 2005-205169 | A | 8/2005 |
| WO | 2004/032076 | | 4/2004 |

OTHER PUBLICATIONS

Supplementary European Search Report dated Aug. 28, 2009 issued in counterpart European Application No. 05 75 1072.

* cited by examiner

PRIZE ACQUISITION GAME APPARATUS

TECHNICAL FIELD

The present invention relates to a prize acquisition game apparatus for acquiring a prize by moving acquiring means provided in a housing, and in particular, to a prize acquisition game apparatus which can change the size of a discharging port for discharging a prize from a housing.

BACKGROUND ART

A number of prize acquisition game apparatuses such as a crane gaming machine, designed for an acquisition by a player of a prize in a housing of the apparatus, are installed in game arcades as well as general stores and shopping malls because the operation itself of such a game apparatus is fun, and also because the chance to acquire a prize featuring a popular character increases a player's willingness to take on the challenge of the game. Conventionally, various prize acquisition game apparatuses have been suggested.

A game apparatus of this type includes a grabbing section which is movable to any position in horizontal and vertical directions within a game space surrounded by transparent plate or semi-spherical member, and which has openable and closable arms (grabbing claws) so that a player can grab one of the prizes disposed in the game space. In order to grab a prize, a player uses operation buttons on an operation panel of the game apparatus to move the grabbing section in a horizontal plane so that the grabbing section is aligned over a desired prize, to stop the grabbing section at that position, and to cause the grabbing section to be automatically lowered to grab the desired prize. Then, the player causes the desired prize to be automatically lifted to a predetermined height, and to be moved in the horizontal plane to a position just above a discharging port with the desired prize being held by a biasing force of the elastic body of the arms, and then the player opens the arms to release the prize so that the prize falls into the discharging port. In the discharging port, the prize falls to the bottom surface of a discharged prize receiving section at a lower part of the discharging port to be received there, and can be taken out of the discharged prize receiving section through a prize outlet, which ends one game (for example, see Japanese Utility Model Publication No. 7-13756).

DISCLOSURE OF INVENTION

Problems to be Solved by the Invention

As described above, a prize acquisition game apparatus such as a crane gaming machine is configured to cause a prize grabbed by arms to be lifted to a predetermined height, and to be moved in a horizontal plane to a position just above a discharging port so as to be dropped into the discharging port from that height. If the arms grab a prize at an inappropriate position, the prize does not fall into the discharging port and instead lands outside the discharging port, with the result that the player cannot acquire it. This configuration increases the difficulty of acquiring a prize, and further increases a player's willingness to take on the challenge of the game.

Such a prize acquisition game apparatus constantly needs prizes which feature more popular characters, and when a plurality of game apparatuses are arranged together, each different game apparatus needs a different type of prize, and accordingly prizes of different sizes are often prepared. In this case, if the discharging port has a fixed size, a prize of small size falls more easily into the discharging port, which decreases the fun of the game. In order to change the size of a discharging port to suit different prizes, it is possible to manufacture the discharging port as an interchangeable unit. Although such an interchangeable unit structure of discharging port has been practically realized, the unit structure has a problem in that it takes considerable time and labor to carry out the work of replacing them. Moreover, if the unit is replaced in a store, the store must provide a space to store the unused unit structures, which adds inconvenience.

The present invention was made in view of the above situation, and one object of the present invention is to provide a prize acquisition game apparatus which does not require replacement of a discharging port structure unit and has a discharging port the size of which can be easily changed. Another object of the present invention is to provide a prize acquisition game apparatus that has a discharging port the size of which can be automatically changed depending on a size of prizes housed in the game apparatus.

Means for Solving the Problems

The present invention relates to a prize acquisition game apparatus for acquiring a prize by moving acquiring means in a housing, and the above described object of the present invention can be achieved by a prize acquisition game apparatus which is characterized in that it comprises: operation means which is operated by a player; a prize housing section for housing a plurality of prizes; prize acquiring means for acquiring a said prize; a discharging port which is formed in the prize housing section for discharging the prize from the prize housing section; control means for controlling the prize acquiring means to operate in response to an operation signal from the operation means; a discharged prize receiving section for receiving the prize discharged through the discharging port by the prize acquiring means which operates under the control of the control means; and sliding means for sliding a frame which is provided on the discharging port to change the size of the discharging port according to a distance the frame is slid.

Furthermore, the above described object of the present invention can be further achieved by a prize acquisition game apparatus which is characterized in that the frame has a first frame which is slidable in a horizontal direction and a second frame for covering a vertical gap which is formed when the first frame slides in a first direction to increase the size of the discharging port, and the frame also has a lid for covering a horizontal gap which is formed when the frame slides in a second direction to decrease the size of the discharging port, and the prize acquisition game apparatus further comprises: driving means for driving the frame to slide; position detecting means for detecting the position of the frame; moving means in a width direction for moving a prize acquiring section of the prize acquiring means in a width direction within the prize housing section; and a memory section for storing a database in which the relationship between a distance from a reference position to a movement limit position of the prize acquiring section in a width direction, information for determining a size of the prize, and a slide position of the frame are set in advance, and further characterized in that the control means calculates a distance from the reference position of the prize acquiring section to the movement limit position based on detection signals from a reference position detecting sensor and a movement limit position detecting sensor, and determines a slide position of the frame which corresponds to the calculated distance by referring to the database, and controls the frame to move it from the current position obtained by the position detecting means to the determined position by driving the driving means.

Alternatively, the above described object of the present invention can be achieved by a prize acquisition game apparatus which is characterized in that it comprises: operation means which is operated by a player; a prize housing section for housing a plurality of prizes; prize acquiring means for acquiring a said prize; a discharging port which is formed in the prize housing section for discharging the prize from the prize housing section; control means for controlling the prize acquiring means to operate in response to an operation signal from the operation means; a discharged prize receiving section for receiving the prize discharged through the discharging port by the prize acquiring means which operates under the control of the control means; and sliding means for sliding a frame which is provided on the discharging port to change the size of the discharging port according to a distance the frame is slid, and further characterized in that the sliding means is configured as a unit which includes: a first frame which defines an aperture of the discharging port between a wall of the prize housing section and a wall of the frame and which is slidable in a horizontal direction; a second frame for covering a vertical gap which is formed when the first frame slides in a first direction to increase the size of the discharging port; a lid for covering a horizontal gap which is formed when the frame slides in a second direction to decrease the size of the discharging port, the lid being formed integrally with the first frame; a fixing member for fixing the unit in place by fastening it to an inside of the prize housing section; and a guide mechanism for guiding the first frame and the lid to slide in a horizontal direction.

Alternatively, the above described object of the present invention can be achieved by a prize acquisition game apparatus which is characterized in that it comprises: operation means which is operated by a player; a prize housing section for housing a plurality of prizes; prize acquiring means which includes a prize acquiring section having arms for acquiring a said prize; a discharging port which is formed in the prize housing section for discharging the prize from the prize housing section; control means for controlling the prize acquiring means to operate in response to an operation signal from the operation means; a frame which is provided near the discharging port for defining the size of the discharging port; slide driving means for driving the frame to slide; a memory section for storing a database of information defining the frame movement; and reading means for reading identifying information associated with the arms of the prize acquiring section to identify a type of the arms, wherein the database comprises data including at least the predetermined relationship between a distance the frame is to be slid and a type of the arms, and the control means determines movement information regarding the frame based on information for identifying a type of the arms which is received from the reading means and with reference to the database, and controls the slide driving means to cause the frame to slide according to the determined movement information.

According to the present invention, the size of a discharging port can be changed by sliding its frame. This facilitates changing the size of a discharging port depending on a prize size, when the prize housed in a prize housing section is replaced with a new one having a larger or smaller size than that of the prize hitherto in the prize housing section. Moreover, this eliminates the work involved in replacing an interchangeable unit structure having a discharging port, and also the need for space for storing such units. Furthermore, since sliding a frame of a discharging port allows its size to be adjusted according to a prize size, space for prizes in a prize housing section can be maximized, and also the difficulty in acquiring a prize by dropping it into the discharging port can be easily adjusted.

BEST MODE FOR CARRYING OUT THE INVENTION

Figure 1:
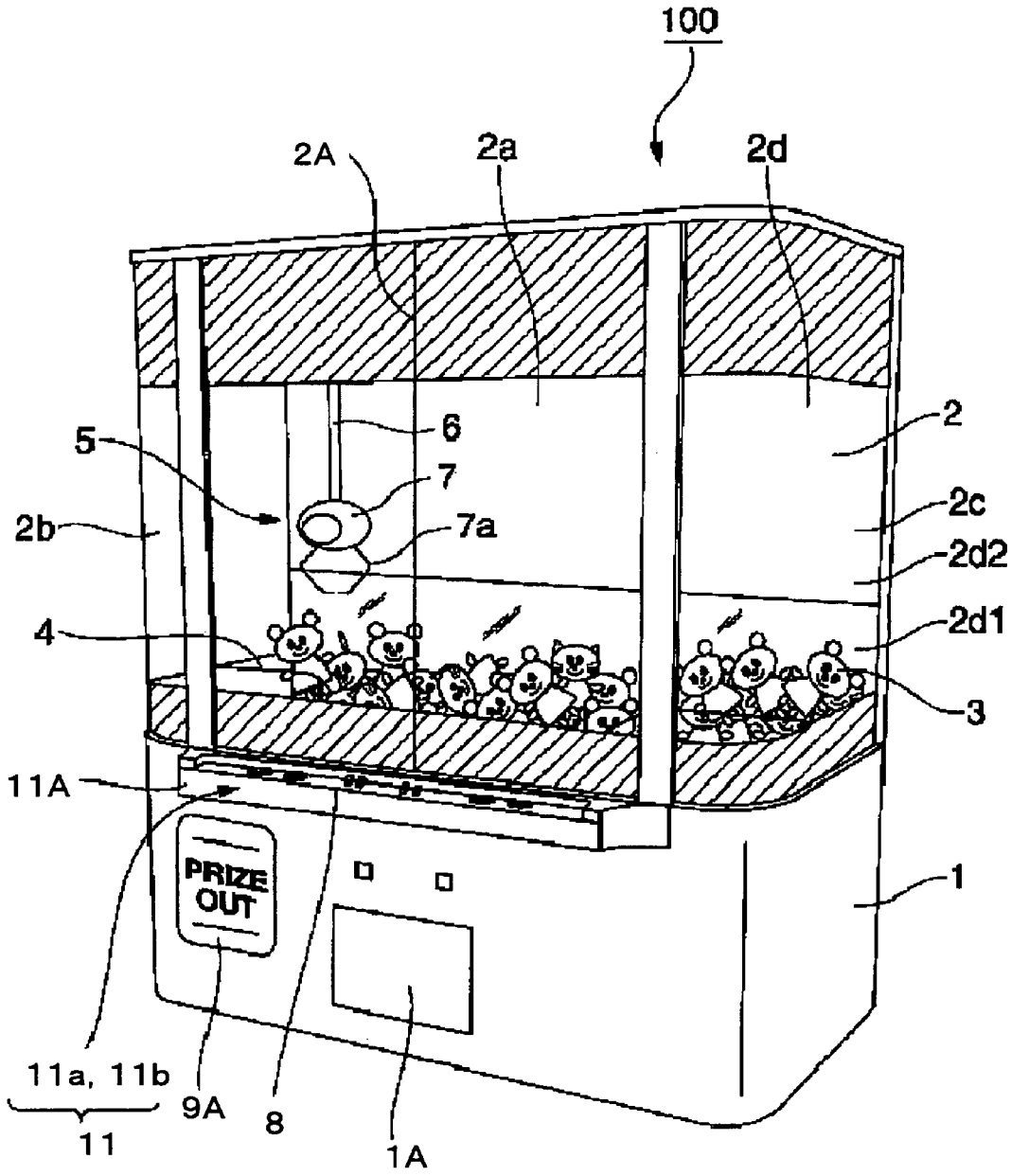
FIG. 1 is a perspective diagram showing the exterior structure of a prize acquisition game apparatus according to the present invention.

FIG. 1 is a perspective diagram showing the exterior structure of a prize acquisition game apparatus according to the present invention.

A prize acquisition game apparatus 100 includes a rectangular base 1 and a box-shaped prize housing section 2 on the base 1, and the prize housing section 2 has a front surface 2*a* and side surfaces 2*b* and 2*c* which are formed of transparent plate-like resin or glass members. The prize housing section 2 has a back surface 2*d* which includes a lower part 2*d*1 of a mirror plate-like member and an upper part 2*d*2 of a white plate-like member. The white color of the back surface 2*d* of the prize housing section 2 makes the inside of the housing section brighter, and also provides a visual effect which makes prizes look better. Since the lower part of the back surface 2*d* has a mirror surface, the reflection of prizes 3 in the housing section provides another visual effect by which a player sees more prizes with the mirror than the actual number. However, the mirror surface is not essential.

The front surface 2*a* of the prize housing section 2 has a door 2A through which a clerk of a store can put the prizes, and the prizes 3 such as stuffed toys are housed in the prize housing section 2.

The prize housing section 2 has an inside with a top surface from which a prize acquiring section 5 is suspended. The prize acquiring section 5 includes a supporting part 6 which is formed of an expandable pipe suspended vertically from the top surface of the inside of the prize housing section 2, and a grabbing part 7 at a distal end of the supporting part 6. The supporting part 6 is configured to be able to be driven by a drive source such as a motor so as to run along a fixed rail for movement in a width direction and along a movable rail for movement in a depth direction, and to be able to expand in a vertical direction. The grabbing part 7 is provided with two openable and closeable arms 7*a* for grabbing a prize 3. The two arms 7*a* are configured to be normally closed, and to be opened to grab a prize.

The prize housing section 2 has a bottom part to which a cylindrical discharging port 4 is formed, opening vertically for discharging a prize 3, so that when the arms 7*a* release a prize 3, the prize 3 falls within a frame of the discharging port 4 to be received in a discharged prize receiving section of the base 1 through a path between the frame and the discharged prize receiving section.

The base 1 is provided with an operation panel 11A with which a player plays a game. The operation panel 11A has a button switch 11 to stop the prize acquiring section 5 at a position relative to a desired prize 3, and a coin slot 8. In this embodiment, the button switch 11 includes a first button switch 11*a* to stop the prize acquiring section 5 at a predetermined position in a width direction (the width direction with respect to the player who is facing the game apparatus), and a second button switch 11*b* to stop the prize acquiring section 5 at a predetermined position in a forward direction (the depth direction with respect to the player who is facing the game apparatus).

Below the operation panel 11A a prize outlet is provided which is covered with a prize dispensing flap 9A, and the prize dispensing flap 9A is opened when a player wins a prize 3 so as to take the dispensed prize 3 out through the prize outlet of the discharged prize receiving section. Moreover, the base 1 has a front surface in which an openable door 1A is formed, and the door 1A covers an interface (not shown) including operation buttons, operation dials, and a liquid crystal display with which a store manager can set up various conditions of the prize acquisition game apparatus 100. The operation of the operation buttons and the like by a store manager to set various conditions allows a computer installed inside the base 1 to control the prize acquisition game apparatus 100 based on those settings.

Figure 2:
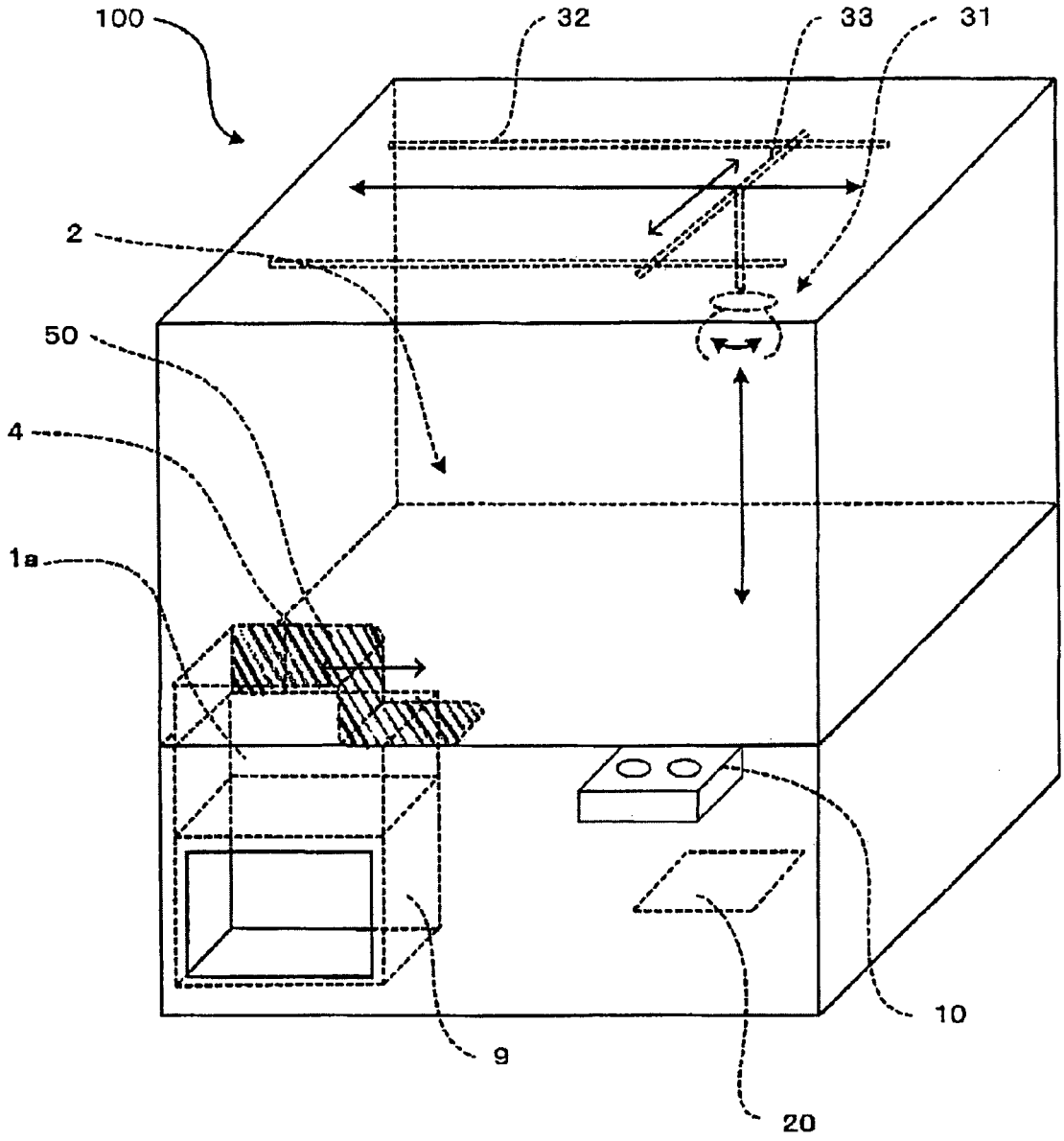
FIG. 2 is a schematic diagram showing the structure of the main part of a prize acquisition game apparatus according to the present invention.
Figure 3:
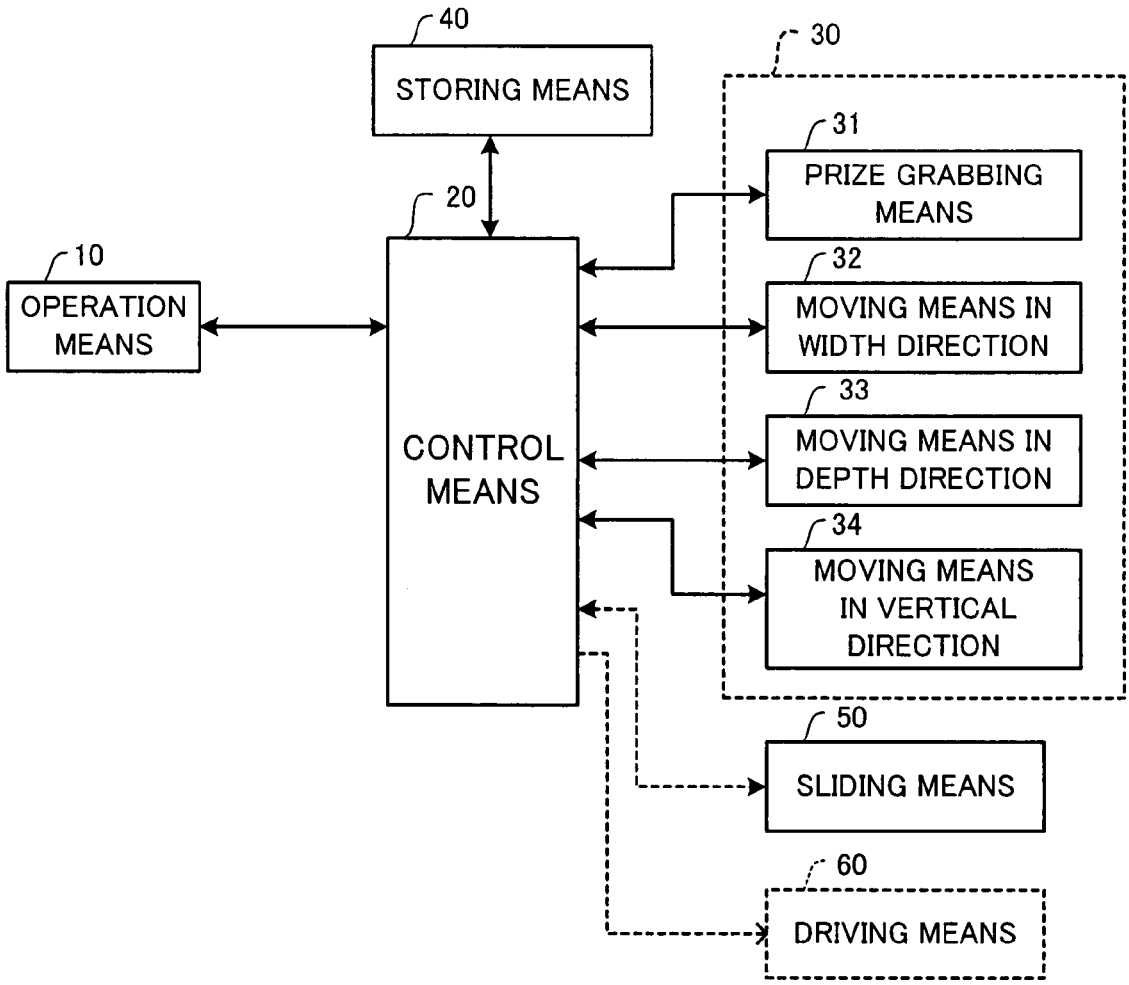
FIG. 3 a block diagram showing the structure of a control system included in a prize acquisition game apparatus according to the present invention.

FIG. 2 is a schematic diagram showing the structure of the main part of a prize acquisition game apparatus according to the present invention, and FIG. 3 is a block diagram showing the structure of a control system included in the prize acquisition game apparatus.

The prize acquisition game apparatus 100 includes: operation means 10 which is operated by a player; prize acquiring means 30 for acquiring a prize 3 which is housed in the space of the prize housing section 2; control means 20 for controlling the prize acquiring means 30 to operate in response to an operation signal from the operation means 10; and storing means 40 for storing an executing program and control data for a prize acquisition game, and information such as the number of prizes a player wins. Furthermore, the basic structure of the embodiment includes, as a characteristic component, although not included in a control system, sliding means 50 for sliding the frame of the discharging port 4 through which a prize 3 is discharged from the prize housing section so that a size of the discharging port 4 is changed according to the distance the frame is slid. Also, in an embodiment which includes driving means 60 as an additional component for driving the frame of the discharging port 4 to slide, the control means 20 is provided with a function for automatically adjusting the size of the discharging port 4 by causing the driving means 60 to drive the frame of the discharging port 4 to slide to a predetermined position. Now, hardware structures and basic functions of each means will be explained below.

The operation means 10 includes operation buttons (first and second button switches 11*a* and 11*b* of FIG. 1) for stopping the prize acquiring section 5 of FIG. 1 at a selected position relative to a desired prize 3.

The prize acquiring means 30 has: prize grabbing means 31 for grabbing a prize housed in the prize housing section; moving means in a width direction 32 for moving the prize grabbing means 31 in a width direction relative to a player who is opposite to the game apparatus; moving means in a depth direction 33 for moving the prize grabbing means 31 in a depth direction (forward direction); and moving means in a vertical direction 34 for moving the prize grabbing means 31 vertically.

The moving means in a width direction 32 and the moving means in a depth direction 33 include a guide mechanism for moving the grabbing part 7 in the corresponding direction (a fixed rail for lateral movement, a movable rail for depth movement, or the like) and a drive source (a motor or the like), and a movement limit position detecting sensor (a sensor for detecting a position or a distance, such as an optical sensor, a limit switch or a magnetic sensor) for avoiding contact between a prize 3 which is grabbed by the arms 7*a* and a wall of the prize housing section 2. The moving means in a vertical direction 34 includes a supporting mechanism having the expandable supporting part 6 for supporting the grabbing part 7, a drive source (a motor or the like) for expanding the supporting part 6 to move the grabbing part 7 vertically, and a movement limit position detecting sensor (a sensor for detecting a position or a distance, such as an optical sensor, a limit switch or a magnetic sensor) for detecting a movement limit position in a downward direction.

The prize grabbing means 31 includes: the grabbing part 7 having arms 7*a* which can grab a prize when closed and can release a prize when opened; a drive source (a motor or the like) for opening and closing the arms 7*a*; an arms angle detecting sensor for detecting the opened/closed state of the arms 7*a*; and a prize release detecting sensor (for example, a weight sensor for detecting the weight of the grabbing part 7). The arms angle detecting sensor and the prize release detecting sensor are used to detect any abnormal event in which, for example, a prize is sandwiched between the arms 7*a* at a position above discharging port 4 and does not fall into the discharging port 4 even when the arms 7*a* are opened.

The control means 20 controls the grabbing part 7 of the prize grabbing means 31 to move in a depth direction and a width direction in response to an operation signal from the operation means 10, so that the grabbing part 7 is moved and positioned in a horizontal plane and the arms 7*a* are opened at the selected position, and then controls the positioned grabbing part 7 to be automatically lowered and to close the arms 7*a* there. The control means 20 then also controls the grabbing part 7 to be automatically lifted to a predetermined height with the arms 7*a* closed, and to move the grabbing part 7 horizontally so that the grabbing part 7 is positioned above discharging port 4 which is formed in the bottom of the prize housing section and the grabbing part 7 is automatically opened there.

Also, the control means 20 detects any abnormal event in which a prize is not released by the opened arms 7*a* based on detection signals of the arms angle detecting sensor and the prize release detecting sensor, and upon detection of an abnormal event, the control means 20 controls the arms 7*a* to be repeatedly opened and closed or controls the supporting part to be repeatedly lowered and lifted at a high speed so that the prize between the arms 7*a* is released and falls down.

The sliding means 50 increases or decreases the size of the discharging port 4 which is formed with the walls of the prize housing section 2 and the walls of the frame by sliding the frame of the discharging port 4 in a horizontal direction, and in the embodiment without driving means 60, the frame is configured to be manually slid to change the size of the discharging port 4. Now, a specific structure of the sliding means 50 will be explained in detail below with reference to the drawings.

Figure 4:
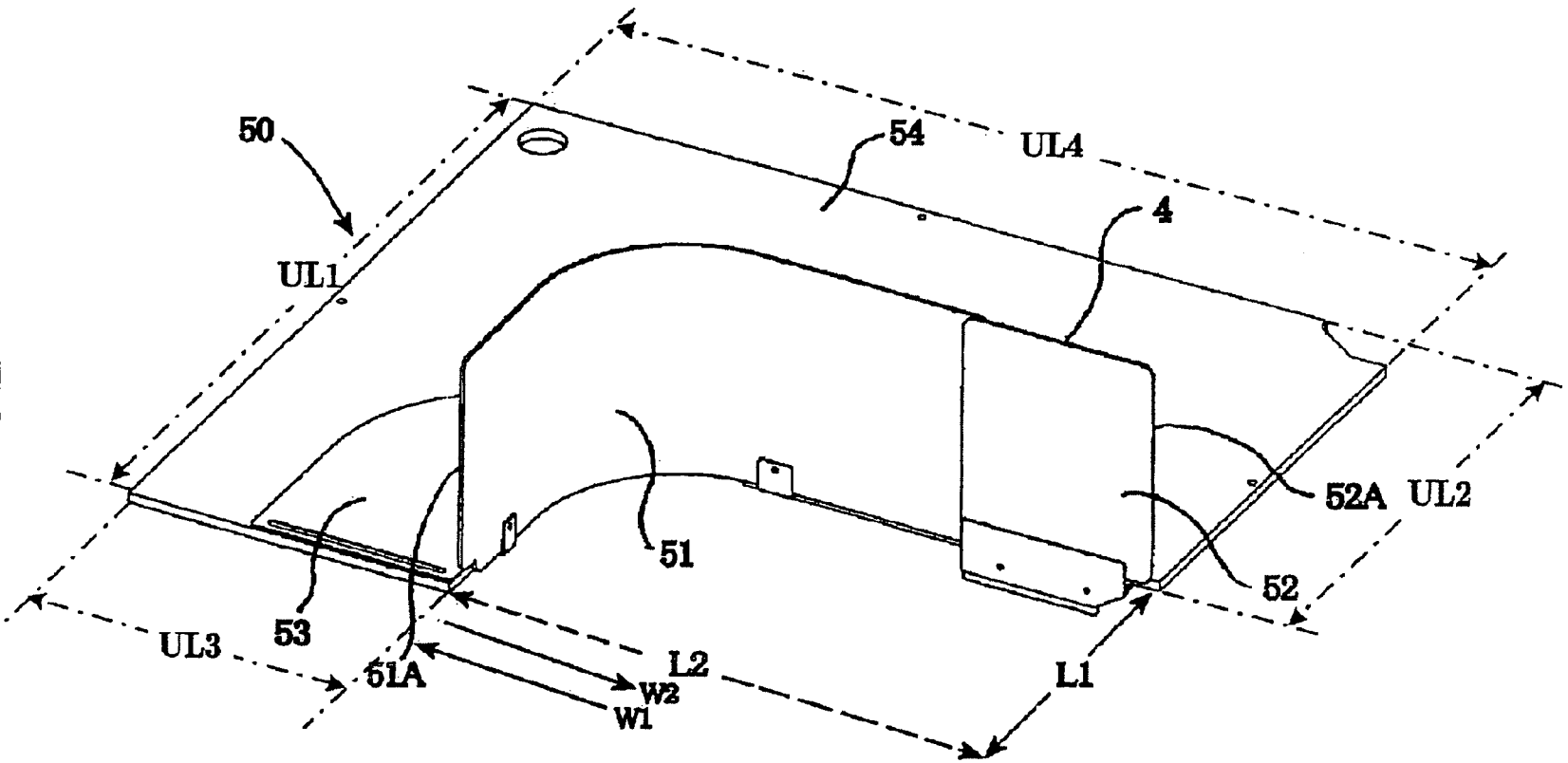
FIG. 4 is a first perspective diagram showing the structure of sliding means according to the present invention.
Figure 5:
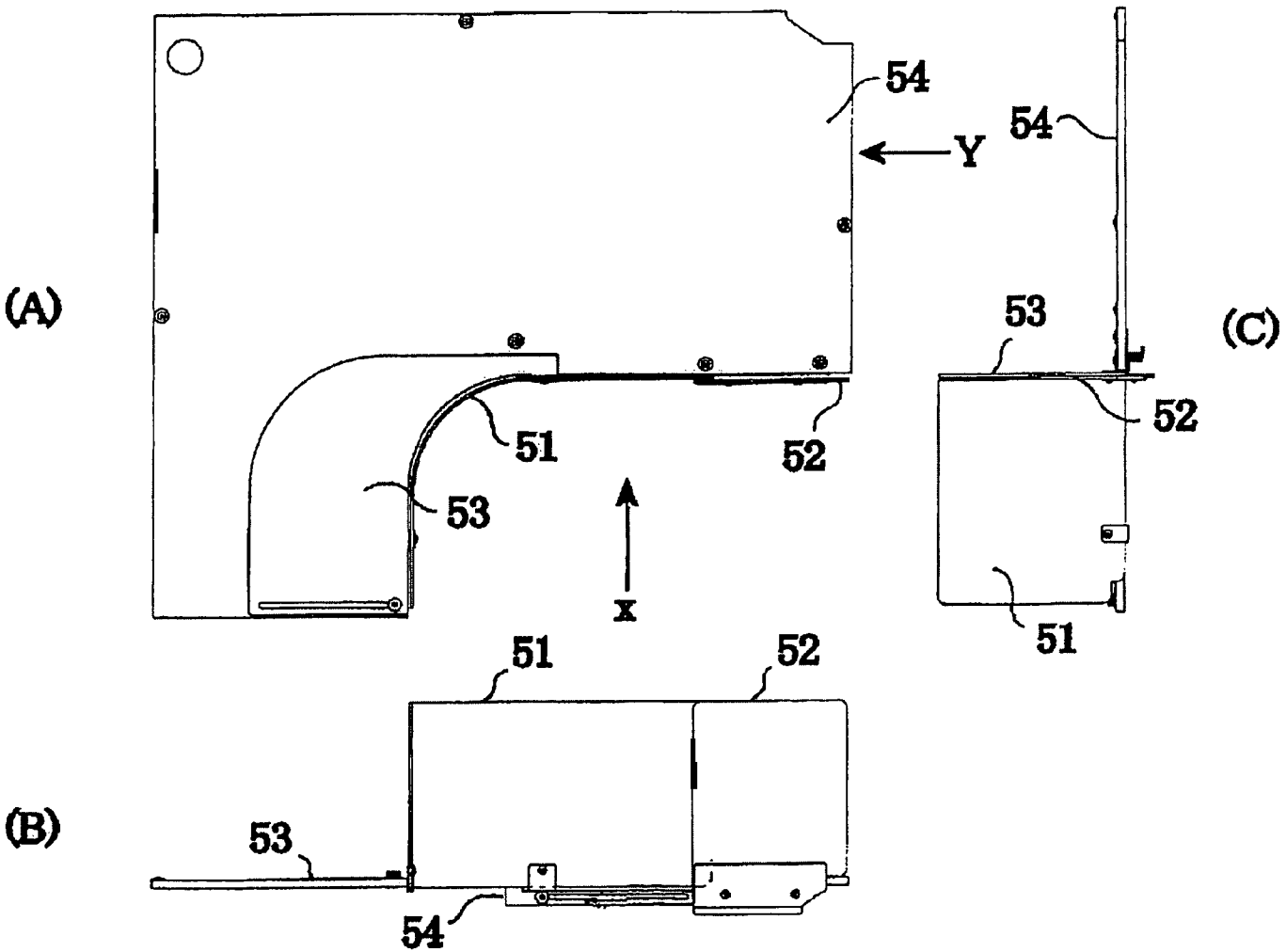
FIG. 5A to 5C are a first top plan diagram, elevation diagram, and side diagram, respectively, showing the structure of sliding means according to the present invention.
Figure 6:
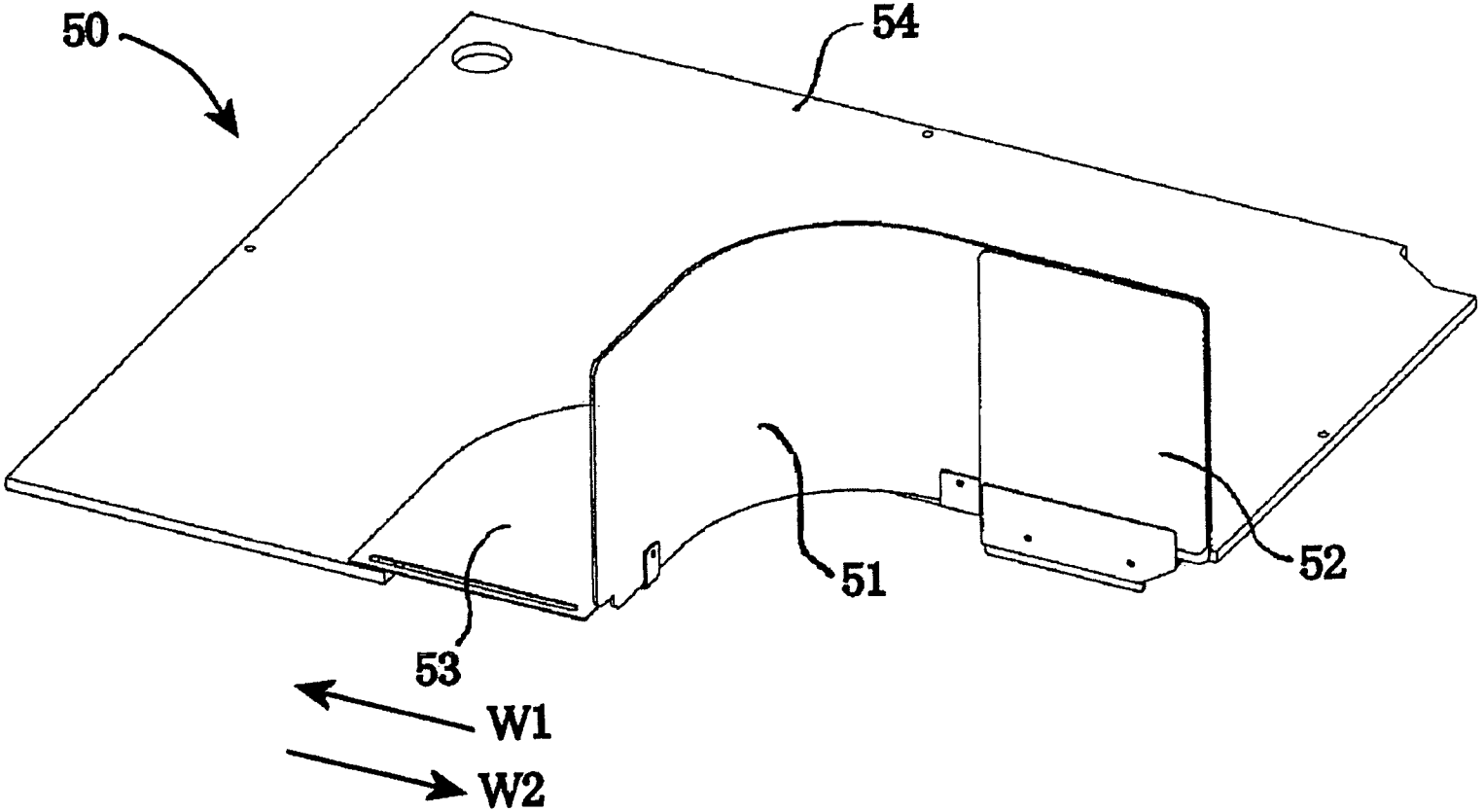
FIG. 6 is a second perspective diagram showing the structure of sliding means according to the present invention.

FIG. 4 is a first perspective diagram showing the structure of the sliding means with the discharging port at the maximum size. FIG. 5A to 5C are a first top plan diagram showing the sliding means of FIG. 4, a diagram showing the same as seen from the direction of an arrow X (an elevation diagram), and a side diagram showing the same as seen from the direction of an arrow Y (a right side diagram), respectively. FIG. 6 is a second perspective diagram showing the structure of the sliding means with the discharging port at the minimum size.

The sliding means 50 according to the present invention (hereinafter, referred to as "a frame sliding unit") includes: a first frame 51 which defines an aperture of the discharging port 4 between a wall thereof and walls of the prize housing section and which is slidable horizontally; a second frame 52 for covering a vertical gap which is formed when the first frame slides in a first direction to increase the size of the discharging port 4 (the direction shown by an arrow W1 in FIG. 4); a lid 53 for covering the horizontal gap which is formed when the frame slides in a second direction to decrease the size of the discharging port 4 (the direction shown by an arrow W2 in FIG. 4), the lid being formed integrally with the first frame 51; a fixing member 54 for fixing the unit in place by fastening the unit to an inside of the prize housing section; and a guide mechanism (not shown) for guiding the first frame 51 and the lid 53 to slide horizontally, such as a guide groove, a rail, or roller. The first frame 51 and the second frame 52 are configured as a dual structure having double-layered walls, in which the second frame 52 is fixed on a fixing member 54 which is a part of the bottom surface of the prize housing section 2, while the first frame 51 slides horizontally on the fixing member 54 using the guide mechanism.

The frame sliding unit 50 in the embodiment is mounted in the prize housing section 2 of the prize acquisition game apparatus 100 so that a wall of the first frame 51, a wall of the second frame 52, and the walls of the prize housing section 2 comprise the entire walls of the discharging port 4, and accordingly sliding movement of the first frame 51 can change the size of the discharging port 4.

When the discharging port 4 is formed at a front left corner of the prize acquisition game apparatus 100 as shown in FIG. 1, the discharging port 4 is arranged so that an end portion 52A of the second frame 52 is in contact with the front surface 2*a* of the prize housing section 2 and an end portion 51A of the first frame 51 is in contact with the side surface 2*b* of the prize housing section 2, and also the frame sliding unit 50 is fixedly mounted by fastening the fixing member 54 (with a fitting part, screws, or the like) to the bottom of the prize housing section 2. Alternatively, when the discharging port 4 is formed at a front right corner of the prize acquisition game apparatus 100, the discharging port 4 is arranged so that an end portion 52A of the second frame 52 is in contact with the side surface 2*c* of the prize housing section 2 and the end portion 51A of the first frame 51 is in contact with the front surface 2*a* of the prize housing section 2, and the frame sliding unit 50 is again fixedly mounted by fastening the fixing member 54 to the bottom of the prize housing section 2. The path below the discharging port 4 and the top aperture of the discharged prize receiving section are larger than the maximum size of the discharging port 4.

In the embodiment of the prize acquisition game apparatus 100 of FIG. 1, the entire walls of the discharging port 4 are formed by the front surface 2*a* and the side surface 2*b* of the prize housing section 2, a wall of the first frame 51 and a wall of the second frame 52 of the frame sliding unit 50. Sliding movement of the first frame 51 in the depth direction increases the size of the discharging port 4 as in FIG. 4, or decreases the size of the discharging port 4 as in FIG. 6. In this embodiment, the wall of the first frame 51 is formed of a generally rectangular transparent member which has a curved surface with a radius of 130 mm, an L1 of about 265 mm, and an L2 of about 497 mm, and the maximum slide distance is about 154 mm, so that the size of the discharging port 4 can be optionally changed within a range of the L2 from 343 mm to 497 mm. The fixing member 54 which forms a part of the bottom of the prize housing section 2 has dimensions, for example as shown in FIG. 4, comprising a UL1 of about 695 mm; a UL2 of about 420 mm; a UL3 of about 294 mm; and a UL4 of about 791 mm.

As described above, the frame sliding unit according to the present invention is configured so that the size of the discharging port 4 can be changed by moving the frame sliding unit, with the result that the work involved in replacing a unit and the like is eliminated, and a size of the discharging port can be easily and optionally changed within a predetermined range.

Next, a function to automatically slide the frame of the frame sliding unit 50 (to change the size of a discharging port) with the use of a control means will be explained.

In the present invention, in an embodiment including the driving means 60 as an additional component for driving and sliding a frame (the first frame 51 in the example) which surrounds the discharging port 4, the control means 20 is provided with a function for automatically adjusting the size of the discharging port 4 by driving the driving means 60 to slide the frame of the discharging port 4 to a predetermined position. The size of the discharging port 4 is preferably determined according to the size of a prize, and therefore the frame which defines the size of the discharging port 4 is desirably automatically slidable according to the size of a prize. There are several forms of the invention which can facilitate changing the size of the discharging port 4 by driving the driving means 60, including: a form which facilitates changing the size of the discharging port 4 with a setting operation performed by staff using the operation buttons (hereinafter, referred to as "a first embodiment"); a form which facilitates automatically changing the size of the discharging port 4 to complement the size of a prize by deducing the size of the prize based on a detection of movement of the moving means in a width direction 32 by a movement limit position detecting sensor or a movement distance detecting sensor (hereinafter, referred to as "a second embodiment"); and a form which facilitates automatically changing the size of the discharging port 4 to complement the size of a prize by identifying the type of a grabbing section of the prize grabbing means 31, which is exchanged depending on a size of a prize, and deducing the size of the prize based on the identification (hereinafter, referred to as "a third embodiment"). Now, the first to third embodiments will be explained below.

In the first embodiment, the size of the discharging port 4 is changed according to an instruction given by staff using the operation buttons which are provided inside the openable door 1A of the prize acquisition game apparatus 10. The control means 20 controls a liquid crystal panel inside the openable door 1A, for example, to display a menu screen for setting the size of the discharging port 4 and to prompt the inputting of an instruction for a change in the size of the discharging port 4. The change in the size can be instructed by inputting a value for a sliding distance, inputting an identifier for a type of a grabbing section, or the selection of a size from a size selection menu, for example. Now, an example of the input of an identifier for a type of grabbing section will be explained. Upon the issue of an instruction to change size using the operation buttons, the control means 20 sends a drive instruction to the driving means (driving means such as a stepping motor) 60 to cause the frame 51 of the frame sliding unit 50 to slide to a reference position (for example, a position of the minimum size). The control means also provides a driving time corresponding to a sliding distance of the frame sliding unit 50 which is pre-set relative to an identifier of a grabbing section, and then provides another drive instruction to the driving means 60 to operate it for the driving time provided. Alternatively, the control means 20 may send a drive instruction every time the operation button is pressed to cause the frame 51 to be repeatedly slid a predetermined distance in the corresponding direction without reference to a control table, so that staff can adjust the size of the discharging port 4 by eye.

Figure 7:
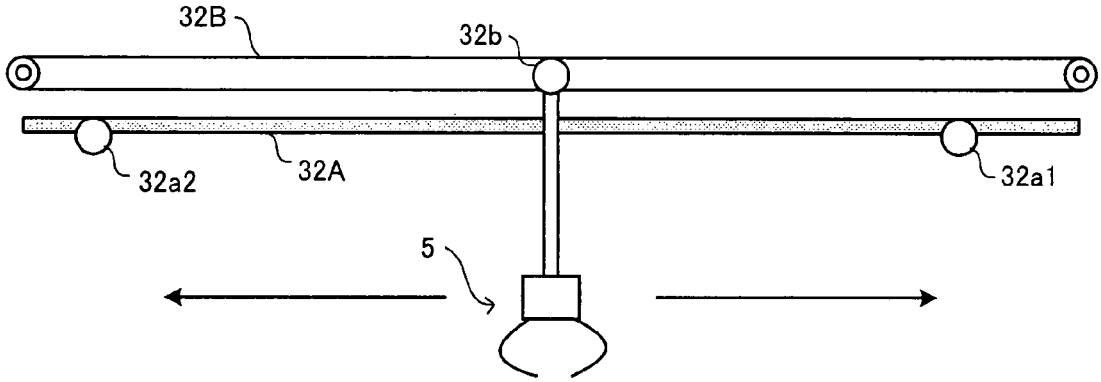
FIG. 7 is a schematic diagram showing the structure of an electric motion mechanism of moving means in a width direction according to the present invention.

In the second embodiment, the frame 51 is automatically slid based on a detection of movement of the moving means in a width direction 32 by a movement limit position detecting sensor or a movement distance detecting sensor. When a prize is exchanged with another one of a different size, the arms 7*a* of the prize grabbing means 31 must be changed to suit. This work is manually performed, and adjustment of the mounting position (movement limit position) of the movement limit position detecting sensor of the moving means in a width direction 32 is also performed. The adjustment is performed so that, while the arms 7*a* are holding a prize of a maximum size, no part of the arms 7*a* or the prize contacts a side surface of the prize housing section. In the second embodiment, the maximum size of a prize is inferred from this adjustment, and a distance the frame 51 is slid is determined based on a detection signal from the movement limit position detecting sensor. The movement limit position detecting sensor detects a movement limit position of the moving means in a width direction 32 using, for example, a light beam projector and a light sensor. As shown by way of example in the schematic diagram of FIG. 7, in addition to a light beam projector 32*a*1 for indicating a movement limit position, a reference position indicating light beam projector 32*a*2 is mounted on the fixed rail 32A. In this example, a light sensor 32*b* is provided on the moving rail 32B for moving the prize acquiring section 5 in a width direction using a conveyor belt or the like.

In such a configuration, the control means 20 drives the moving means in a width direction 32 to move the prize acquiring section 5 to the reference position and then to the movement limit position so as to calculate the distance between them based on conveyance velocity and detection times of signals obtained by the light sensor 32*b* at the two positions. Then, the control means 20 refers to a database (or a predetermined arithmetic expression) in which the relationship between information indicating the size of a prize (in this example, the distance from a reference position to a movement limit position of the moving means in a width direction 32) and information regarding frame movements is set in advance, and determines a slide position for the frame 51 which corresponds to the prize size estimated from the calculated distance, and accordingly the control means 20 controls driving means 60 to drive the frame to the determined slide position. As a result, a size of the discharging port 4 can be changed depending on a prize size. The positions for the light beam projector and light sensor may be reversed. The term "information regarding frame movements" as used above is the information for controlling movements of a frame, including the slide distance, the position after sliding, and the sliding direction of a frame, and the database which holds the information of frame movements is stored in the storing means 40.

The above example does not have a sensor on the frame sliding unit 50, but position detecting means for detecting a current position of the frame 52 (a position detecting sensor or a distance detecting sensor, such as a light beam projector/light sensor as described above, a limit switch, or a magnetic sensor) may be mounted on the frame sliding unit 50 to enable control of the frame 52 movement from the current position to a desired position. In this case, the control means 20 calculates a distance from a reference position of the prize acquiring section 5 to a movement limit position in a width direction based on detection signals from a reference position detecting sensor and a movement limit position detecting sensor, refers to the database in which the relationship between the distance from a reference position of the prize acquiring section 5 to a movement limit position in a width direction and the prize size (the size of a prize 3 to be received) and a slide position for the frame 52 is set in advance, and then determines a slide position for the frame 52 which corresponds to the calculated distance, and also detects the current position of the frame 52 using position detecting means, and then drives the driving means 60 to so that the frame 52 is controlled to move to the determined position. This configuration allows the frame 52 to be more accurately positioned, and allows the size of the discharging port 4 to be changed to suit the size of the prize which is received therein.

Figure 8:
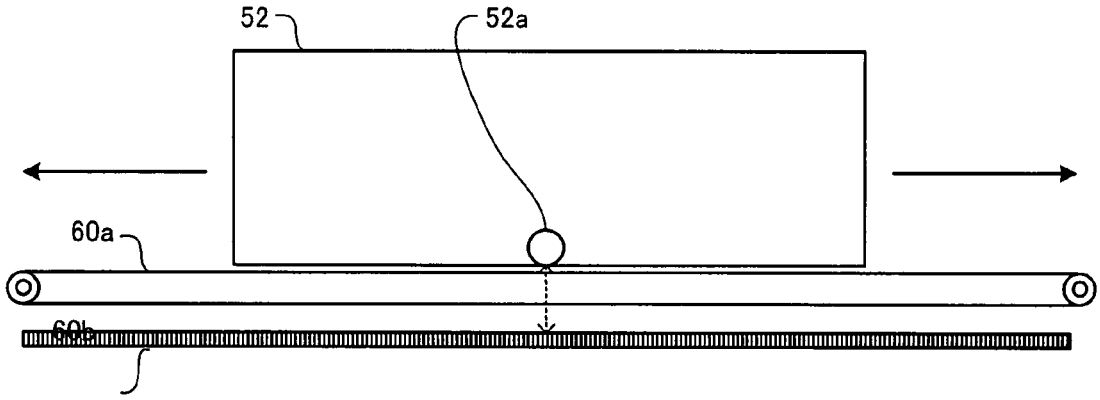
FIG. 8 is a schematic diagram showing the structure of an electric slide mechanism for sliding means according to the present invention.

FIG. 8 is a schematic diagram showing the structure of a frame sliding unit 50 which has frame position detecting means. In this example, the position detecting means 52*a* is provided on the conveying means (a moving rail or a conveyor belt) 60*a* of the frame 52. If the position detecting means 52*a* is an optical sensor, a reflecting film having a stripe pattern 60*b* is for example attached to the opposite side so that reflected light (or transmitted light) is received by the optical sensor. When the optical sensor sends a light receiving signal, the control means 20 determines the current position of the frame 52 based on the signal so as to control the frame 52 to be electrically moved to the determined position. This control system using the position detecting means 52*a* can also be employed in the third embodiment which will be explained below.

The above described second embodiment may be modified to the following embodiment.

Detecting means for detecting the mounted position of the movement limit position detecting sensor itself is provided, so that a size of a prize is estimated based on a detection signal from the detecting means and a size of the discharging port 4 is automatically changed depending on the prize size.

For example, when there are three types of arms 7*a*, "large", "middle", and "small", (1) first to third sensors (detecting means) for detecting the presence or absence of the movement limit position detecting sensor itself at positions where the movement limit position detecting sensor should be mounted for the "large" arms 7*a*, the "middle" arms 7*a*, and the "small" arms 7*a* respectively are mounted on the rail (moving means in a width direction), and also (2) fourth to sixth sensors (detecting means) for detecting the presence or absence of the frame at positions where the frame should be for the "large" arms 7*a*, the "middle" arms 7*a*, and the "small" arms 7*a* respectively are mounted on a frame slide guide rail. With the use of these sensors, one of the "large", "middle" or "small" types of arms 7*a* is detected.

As a control procedure, first, a person changes the position at which the movement limit position detecting sensor is mounted. For example, the sensor is shifted from the "position for the middle arms" to the "position for the large arms" (S1-1). In this case, the first sensor for detecting the presence or absence of the movement limit position detecting sensor itself at the "position for the large arms" detects its presence at that position (S1-2). At step S1-2, the control means 20 receives the detection signal and locates the frame. Specifically, using of one of the fourth to sixth sensors for detecting the presence or absence of the frame at the positions appropriate for the "large" arms 7*a*, the "middle" arms 7*a*, and the "small" arms 7*a*, the current position of the frame can be detected. In this example, with a use of the fifth sensor which corresponds to the "middle" arms, the frame is detected at the "position for the middle arms" (S1-3).

The control means 20 drives a motor to cause the frame to move to the "position for the large arms" (for example, this is achieved by a program which is executed based on a table of data defining the rotations of a motor, such as a clockwise rotation for the size change from middle to large, a counter-clockwise rotation for the size change from middle to small, and the like) (S1-4). The control at step S1-4 allows the frame to be automatically moved by the drive motor with a conveyor belt. Then, the control means 20 receives a detection signal from the sixth sensor which corresponds to the "large arms", and stops the rotation of the motor (S1-5). In this way, the "frame" automatically reaches the "position for the large arms" from the "position for the middle arms".

In the third embodiment, the type of grabbing section (arms) of the prize grabbing means 31, which is exchanged depending on the size of a prize, is detected, and the size of the prize is estimated based on the detection signal so as to automatically change the size of the discharging port 4 to be appropriate for that size of prize. The type of grabbing section can be detected for example by providing an ID tag to the grabbing section (non-contact ID tag or IC tag to which electric power is supplied by electromagnetic induction and by which data communication with other tags can be achieved without contact) and reading means (an antenna or the like) for reading the ID (an identifier which represents the type of grabbing section) on the ID tag without contact, and then a preset slide position corresponding to the read ID is taken from a database so that the driving means 60 is controlled to electrically move the frame 52 to that position.

Such a discharging port size change function may be provided in the control means 20, which allows a size of the discharging port 4 to be automatically changed depending on a prize size.

The above described third embodiment may be modified to the following embodiment.

For example, when there are three types of arms 7*a*, "large", "middle", and "small", first to third sensors (detecting means) for detecting the presence or absence of the frame are mounted on the slide guide rail at positions where the frame should be mounted for the "large" arms 7*a*, the "middle" arms 7*a*, and the "small" arms 7*a* respectively.

As a control procedure, first, a person exchanges the arms 7*a*. For example, the "middle" arms 7*a* are replaced with the "large" arms 7*a* (S21-1). The reading means reads the "large" arms identifying information, and the control means 20 detects the current position of the frame. The detection is conducted by using the second sensor to detect the presence or absence of the frame at the position where the frame should be for the current "middle" arms (S21-2). At (S21-2), the control means 20 determines that the frame is at the "position for the middle arms", and rotates the motor to cause the frame to move to the "position for the large arms" (for example, this is achieved by a program which is executed based on a table of data defining the rotations of a motor, such as a clockwise rotation for the size change from middle to large, a counter-clockwise rotation for the size change from middle to small, and the like) (S21-3). The frame is automatically moved by the drive motor with a conveyor belt. Then, the control means 20 receives a detection signal from the first sensor which corresponds to the "large" arms, and stops the rotation of the motor (S21-4). In this way, the frame automatically reaches the "position for the large arms" from the "position for the middle arms".

Now, an operation of a prize acquisition game apparatus according to the present invention configured as described above will be explained below.

Figure 9:
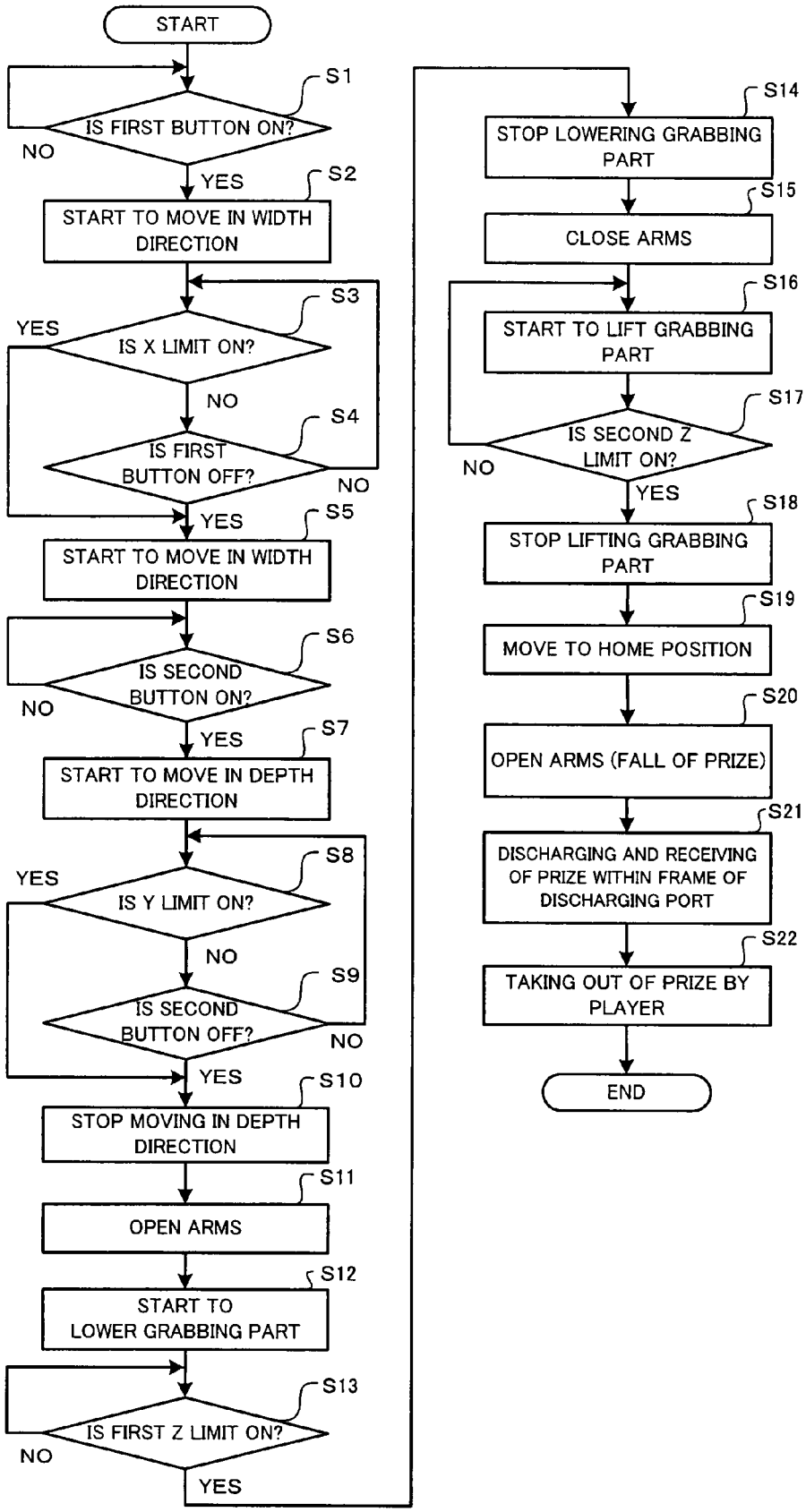
FIG. 9 is a flowchart showing operation of a prize acquisition game apparatus according to the present invention.

FIG. 9 is a flowchart showing operation of a prize acquisition game apparatus according to the present invention. Basic operation of a prize acquisition game apparatus will be explained below on the assumption that the size of the discharging port 4 has been changed in advance. The term "X limit flag" as used in the following explanation is a flag denoting that the grabbing part 7 has moved to a movement limit position in a width direction, the term "Y limit flag" is a flag denoting that the grabbing part 7 has moved to a movement limit position in a depth direction, the term "first Z limit flag" is a flag denoting a movement limit distance in a downward direction when a player allows the prize acquiring section 5 to be automatically lowered after positioning it in a horizontal plane, and the term "second Z limit flag" is a flag denoting a movement limit distance in a upward direction. These flags are set by the control means 20 based on detection signals from corresponding sensors.

In an initial state, the prize acquiring section 5 is at a home position, and when a player inserts a coin through the coin slot 8, the prize acquisition game apparatus 100 is ready to start a game. Then the control means 20 of the prize acquisition game apparatus 100 determines whether the first button switch 11*a* is on or not (step S1), and if the switch 11*a* is on, the control means 20 operates a drive source of the moving means in a width direction 32 to cause the prize acquiring section 5 to move in a width direction (step S2). Subsequently, the control means 20 determines whether the X limit flag is on or not (step S3). If the flag is not on, the control means 20 determines whether the first button switch 11*a* is on or not (step S4), and if the switch 11*a* is off, the control means 20 stops the operation of the drive source to stop the movement of the prize acquiring section 5 in a width direction (step S5).

Next, the control means 20 determines whether the second button switch 11*b* is on or not (step S6), and if the switch 11*b* is on, the control means 20 operates a drive source of the moving means in a depth direction 33 to cause the prize acquiring section 5 to move in a depth direction (step S7). Subsequently, the control means 20 determines whether the Y limit flag is on or not (step S8). If the flag is not on, the control means 20 determines whether the second button switch 11*b* is on or not (step S9), and if the switch 11*b* is off, the control means 20 stops the operation of the drive source to stop the movement of the prize acquiring section 5 in a depth direction (step S10).

Subsequently, the control means 20 drives a motor of the grabbing part 7 to open the arms 7*a* (step S11) and extend the supporting part 6 downward so as to lower the grabbing part 7 (step S12). Subsequently, the control means 20 determines whether the first Z limit flag is on or not (step S13), and if the flag is on, the control means 20 stops the lowering of the grabbing part 7 (step S14), and stops the motor to close the arms 7*a* (step S15). By this means, a desired prize 3 can be grabbed by the arms 7*a*.

Subsequently, the control means 20 retracts the supporting part 6 upward so as to lift the grabbing part 7 (step S16), and determines if the second Z limit flag is on or not (step S17). If the flag is on, the control means 20 stops lifting of the grabbing part 7 (step S18). Then the control means 20 causes the prize acquiring section 5 to move back to the home position (step S19). After the positioning of the prize acquiring section 5 at the home position, the control means 20 stops the motor to open the arms 7*a*. If the prize 3 is grabbed by the arms 7*a*, the prize 3 is released by the opening of the arms 7*a*, and falls into the discharging port 4. If a prize release detecting sensor is provided, the control means 20 determines whether any abnormal event has occurred, a prize being sandwiched between the arms 7*a* such that it does not fall, for example, based on a detection signal from the sensor, and if the control means 20 determines that an abnormal event has occurred, the control means 20 controls the arms 7*a* to be repeatedly opened and closed by a small amount or controls the grabbing part 7 to be repeatedly moved a small distance in horizontal and vertical directions so as to try to shake off the prize (step S20). Once the prize 3 enters the frame of the discharging port 4, the prize 3 falls through a path and is received in the discharged prize receiving section 9. The path below the frame of the discharging port 4, in this example, is formed by mounting a cylindrical member to couple vertically between the bottom of the discharging port 4 and the top aperture of the discharged prize receiving section 9 so that a prize which is discharged from the discharging port 4 can reach the discharged prize receiving section 9. In an embodiment in which a prize detecting sensor (not shown) is provided at an upper part of an inside wall of the discharged prize receiving section 9 for detecting a falling prize, a prize which is falling onto a buffer unit 50 is detected based on the detection signal of the sensor, and the total number of the prizes is counted and recorded in the storing means 40 (step S21). The prize received in the discharged prize receiving section 9 is taken out through a prize outlet 9*a* (step S22), which ends one game.

The above flowchart is explained with regard to a case where the home position is identical to the position from which a prize falls (a position above the discharging port), but these positions may not be identical. In the latter case, the control means 20 does not cause the release of a prize 3 by opening the arms 7*a* after the prize acquiring section 5 is automatically moved to the home position as described above in S19 and S20. Instead, as a control procedure, at step S19, the control means 20 causes the prize acquiring section 5 to be positioned above the discharging port 4 in response to an operation signal from the operation means 10, and at step S20, drives driving means to open the arms 7*a*, and then causes the arms 7*a* to be closed and be automatically moved to the home position. Also, in the above explanation of step S20, a prize release detecting sensor is provided, but in a prize acquisition game apparatus without a prize release detecting sensor, the process for determining an abnormal event and the process for shaking off a prize can be eliminated.

In the above described embodiment, sliding means (a frame sliding unit) is provided which includes a frame for defining the size of a discharging port and which changes the size of the port by moving the frame in a horizontal direction, but another slide mechanism having a similar configuration for sliding a frame in a vertical direction may be further provided so that a height of a discharging port can be changed to a height greater than the maximum height of a prize by using the slide mechanism. Moreover, in the above described embodiment, the cylindrical wall around the aperture of a discharging port is constituted by an L-shaped wall of a frame and a curved wall of a prize housing section, but the wall may be formed with a U-shaped wall of a first frame and a flat wall of the front or side wall of a prize housing section. In this case, a second frame may be configured as a dual structure having two double-layered walls which are parallel to the walls at the both ends of the first frame respectively, so that the two walls of the second frame can cover the gaps which are formed when the first frame slides to increase a size of a discharging port. Also, in the above described embodiment, the frame slides in a width direction, but the frame may equally be a mechanism which slides in a depth direction as well as a width direction.

INDUSTRIAL APPLICABILITY

The sliding means according to the present invention can be applied not only to a game apparatus but also to an apparatus in which an article in a housing is acquired by using a robot hand or the like to discharge it from the housing through a discharging port, as a means for changing the size of the discharging port.

The invention claimed is:

1. A prize acquisition game apparatus, characterized in that it comprises:

operation means which is operated by a player;

a prize housing section for housing a plurality of prizes;

prize acquiring means for acquiring a said prize;

a discharging port which is formed in the prize housing section for discharging the prize from the prize housing section;

control means for controlling the prize acquiring means to operate in response to an operation signal from the operation means;

a discharged prize receiving section for receiving the prize discharged through the discharging port by the prize acquiring means which operates under the control of the control means; and sliding means for sliding a frame which is provided on the discharging port to change the size of the discharging port according to a distance the frame is slid;

wherein the frame has a first frame which is slidable in a horizontal direction, and a second frame for covering a vertical gap which is formed when the first frame slides in a first direction to increase the size of the discharging port; and wherein the frame has a lid for covering a horizontal gap which is formed when the frame slides in a second direction to decrease the size of the discharging port.

2. The prize acquisition game apparatus according to claim 1, characterized in that it further comprises:

driving means for driving the frame to slide;

position detecting means for detecting the position of the frame;

moving means in a width direction for moving the prize acquiring section of the prize acquiring means in a width direction within the prize housing section;

and a memory section for storing a database in which the relationship between a distance from a reference position to a movement limit position of the prize acquiring section in a width direction, information for determining the size of a prize, and a slide position of the frame are set in advance, and further characterized in that the control means calculates a distance from the reference position to the movement limit position of the prize acquiring section based on detection signals from a reference position detecting sensor and a movement limit position detecting sensor, and determines a slide position of the frame which corresponds to the calculated distance by referring to the database, and also controls the frame to move it from the current position obtained by the position detecting means to the determined position by driving the driving means.

3. A prize acquisition game apparatus, characterized in that it comprises:

operation means which is operated by a player;

a prize housing section for housing a plurality of prizes;

prize acquiring means for acquiring a said prize;

a discharging port which is formed in the prize housing section for discharging the prize from the prize housing section;

control means for controlling the prize acquiring means to operate in response to an operation signal from the operation means;

a discharged prize receiving section for receiving the prize discharged through the discharging port by the prize acquiring means which operates under the control of the control means; and sliding means for sliding a frame which is provided on the discharging port to change the size of the discharging port according to a distance the frame is slid, and the sliding means is configured as a unit which includes: a first frame which defines an aperture of the discharging port between a wall of the prize housing section and a wall of the frame and which is slidable in a horizontal direction; a second frame for covering a vertical gap which is formed when the first frame slides in a first direction to increase the size of the discharging port; a lid for covering a horizontal gap which is formed when the frame slides in a second direction to decrease the size of the discharging port, the lid being formed integrally with the first frame; a fixing member for fixing the unit in place by fastening it to an inside of the prize housing section; and a guide mechanism for guiding the first frame and the lid to slide in a horizontal direction.

* * * * *